US006343775B1

(12) United States Patent
Jones et al.

(10) Patent No.: US 6,343,775 B1
(45) **Date of Patent: *Feb. 5, 2002**

(54) KEYBOARD SUPPORT WITH QUICK CONNECT

(75) Inventors: David K. Jones, Grand Rapids, MI (US); Curtis G. Berndt, Fremont, IN (US); Daniel R. Johnson-Zeh, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/660,713

(22) Filed: Sep. 13, 2000

Related U.S. Application Data

(63) Continuation of application No. 09/004,985, filed on Jan. 9, 1998, now Pat. No. 6,135,405, which is a continuation-in-part of application No. 08/561,667, filed on Nov. 22, 1995, now Pat. No. 5,836,560.

(51) Int. Cl.[7] ..... E04G 3/00

(52) U.S. Cl. ..... 248/284.1; 248/918

(58) Field of Search ..... 248/284.1, 286.1, 248/918, 291.1, 281.11, 278.1, 279.1, 289.11; 108/69, 75, 140, 145, 2, 10

(56) References Cited

U.S. PATENT DOCUMENTS

| | | | |
|---|---|---|---|
| 651,539 | A | 6/1900 | Warren |
| 719,625 | A | 2/1903 | Throm |
| 1,982,954 | A | 12/1934 | Grobe |
| 3,820,752 | A | 6/1974 | Oram |
| 4,421,035 | A | 12/1983 | Gubbe et al. |
| 4,502,656 | A | 3/1985 | Zeitler |
| 4,508,305 | A | 4/1985 | Johnson et al. |
| 4,545,555 | A | 10/1985 | Koch |
| 4,564,179 | A | 1/1986 | Hollingsworth |
| 4,616,798 | A | 10/1986 | Smeenge et al. |
| D288,097 | S | 2/1987 | Harter et al. |
| 4,699,346 | A | 10/1987 | Bahm |
| 4,706,919 | A | 11/1987 | Soberalski et al. |
| 4,744,019 | A | 5/1988 | Krogsrud |
| 4,776,284 | A | 10/1988 | McIntosh |
| 4,826,123 | A | 5/1989 | Hannah et al. |
| 4,834,329 | A | 5/1989 | Delapp |
| 4,863,133 | A | 9/1989 | Bonnell |
| 4,883,316 | A | 11/1989 | Austin, Jr. et al. |
| 4,938,442 | A | 7/1990 | Mastrodicasa |
| 4,988,066 | A | 1/1991 | Cotterill |
| 5,037,054 | A | 8/1991 | McConnell |

(List continued on next page.)

FOREIGN PATENT DOCUMENTS

| | | |
|---|---|---|
| DE | 2847135 | 5/1980 |
| GB | 2176996 | 1/1987 |
| JP | 6077426 | 1/1983 |
| JP | 6095036 | 12/1983 |
| JP | 60163040 | 4/1984 |
| JP | 6076428 | 11/1985 |
| JP | 60180029 | 11/1985 |

*Primary Examiner*—Ramon O. Ramirez
*Assistant Examiner*—Gwendolyn Baxter
(74) *Attorney, Agent, or Firm*—Price, Heneveld, Cooper, DeWitt & Litton

(57) ABSTRACT

A keyboard support assembly for supporting computer keyboards and the like. The keyboard support assembly includes an articulating support arm having an end portion adapted to be secured to an associated base. The articulating support arm also defines an opposite end portion. A keyboard support member is adapted to support a keyboard thereon. The keyboard support assembly further includes a threadless quick connector releasably connecting the keyboard support member to the articulating support arm adjacent the opposite end portion thereof.

13 Claims, 10 Drawing Sheets

U.S. PATENT DOCUMENTS 5,041,770 A 8/1991 Seiler et al.
5,098,053 A 3/1992 Cotterill
5,145,136 A 9/1992 McConnell
5,211,367 A * 5/1993 Musculus ..... 248/279
5,230,289 A 7/1993 George et al.
5,257,767 A 11/1993 McConnell
5,351,897 A 10/1994 Martin
5,421,289 A 6/1995 Capellaro
5,564,667 A 10/1996 Copeland et al.
5,611,650 A 3/1997 Perkins et al.
5,683,064 A * 11/1997 Copeland ..... 248/278.1
5,730,408 A 3/1998 McAllister et al.
5,775,657 A 7/1998 Hung
5,778,799 A 7/1998 Eyre
5,832,840 A 11/1998 Woof
5,836,562 A * 11/1998 Danzyger et al. ..... 248/295.11
5,878,674 A 3/1999 Allan
6,012,693 A * 1/2000 Voeller ..... 248/280.11
6,135,405 A * 10/2000 Jones et al. ..... 248/284.1

* cited by examiner

KEYBOARD SUPPORT WITH QUICK CONNECT

CROSS-REFERENCES TO RELATED APPLICATIONS

The present application is a continuation of application Ser. No. 09/004,985, entitled TILT LOCKOUT FOR ARTICULATED KEYBOARD SUPPORTS, filed on Jan. 9, 1998, the entire contents of which are hereby incorporated herein by reference. Application Ser. No. 09/004,985 is a continuation-in-part of application Ser. No. 08/561,667, now U.S. Pat. No. 5,836,560, entitled Articulated Keyboard Shelf, filed on Nov. 22, 1995.

BACKGROUND OF THE INVENTION

The present invention relates to keyboard supports and the like, and in particular to an articulated keyboard support system having a tilt lockout that reduces the tilt range of a keyboard support, and a quick-disconnect connector that removably mounts the keyboard support to a mounting member.

Personal computers are becoming more common in many industry and office environments. Such systems may employ a keypad, mouse, and/or other data input devices, such as a digitizing pad. Often, the personal computer occupies much of the desk or worksurface, making it difficult to locate the keyboard thereon. Furthermore, many users do not prefer to locate the keyboard on the desktop because it is uncomfortable to address the keyboard over the course of the work day.

A number of devices have been developed to offer greater flexibility in supporting the keyboard, mouse, or other user interface devices at a comfortable position relative to the user. Many of these systems are structurally complex and typically require rather awkward adjustments through manipulations of a number of knobs and levers or handles. Moreover, many of the adjustable keyboard supports available today utilize an adjustment system which is counter-intuitive, such that the user must learn a detailed sequence of steps, knobs, locks, etc. before the device can be used effectively instead of simply moving the keyboard directly to the desired position.

Available keyboard support surfaces may incorporate a tilt adjustment device allowing the keyboard support surface to be adjusted over a range of tilt angles. The range of available tilt angles cannot be changed, such that the maximum and minimum allowable tilt angles are fixed. However, for some applications the entire range of tilt adjustability may not be needed or desired.

In addition, available keyboard support assemblies include a keyboard support surface that is permanently attached to a height adjustment device. Various keyboard support configurations have been developed and may include a hand support, a mouse support, or a specific keyboard clamping arrangement. In addition, the keyboard support surface may be configured for integration, with a specific worksurface, such as, for example, a corner worksurface. However, a keyboard support surface configured for a specific worksurface, such as a corner worksurface, may not be compatible with other types of worksurfaces. Accordingly, if a different keyboard support surface configuration is desired, the entire assembly, including the height adjustment device, must be replaced.

Accordingly, there was a need for a keyboard support with improved features which alleviated the above-identified problems.

SUMMARY OF THE INVENTION

One aspect of the present invention is to provide a keyboard support assembly for supporting computer keyboards and the like. The keyboard support assembly includes an articulating support arm having an end portion adapted to be secured to an associated base. The support arm also includes an opposite end portion. A keyboard support member is adapted to support a keyboard thereon. The keyboard support assembly further includes a threadless quick connector releasably connecting the keyboard support member to the articulating support arm adjacent the opposite end portion thereof.

Another aspect of the present invention is a keyboard support assembly for supporting keyboards and the like including an articulating support arm having an end portion adapted to be secured to an associated base. The support arm also includes an opposite end. A keyboard support member is adapted to support a keyboard thereon, and a first lock member is positioned on a selected one of the articulating support arm and the keyboard support member. A second lock member is movably mounted on the other of the articulating support arm and the keyboard support member. The second lock member is shiftable between a disengaged position and an engaged position wherein the second lock member engages the first lock member to secure the keyboard support member to the articulating support arm adjacent the opposite end.

Yet another aspect of the present invention is a keyboard support assembly for supporting keyboards. The keyboard support assembly includes an articulating support arm and a keyboard support platform adapted to support a keyboard thereon. The keyboard support assembly also includes a projection on a selected one of the articulating support arm and the keyboard support platform, the projecting defining a first engagement surface. A movable lock member is movably mounted on the other of the articulating support arm and the keyboard support platform. The lock member is shiftable between a released position and a locked position wherein the lock member engages the first engagement surface and secures the keyboard support platform to the articulating support arm.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
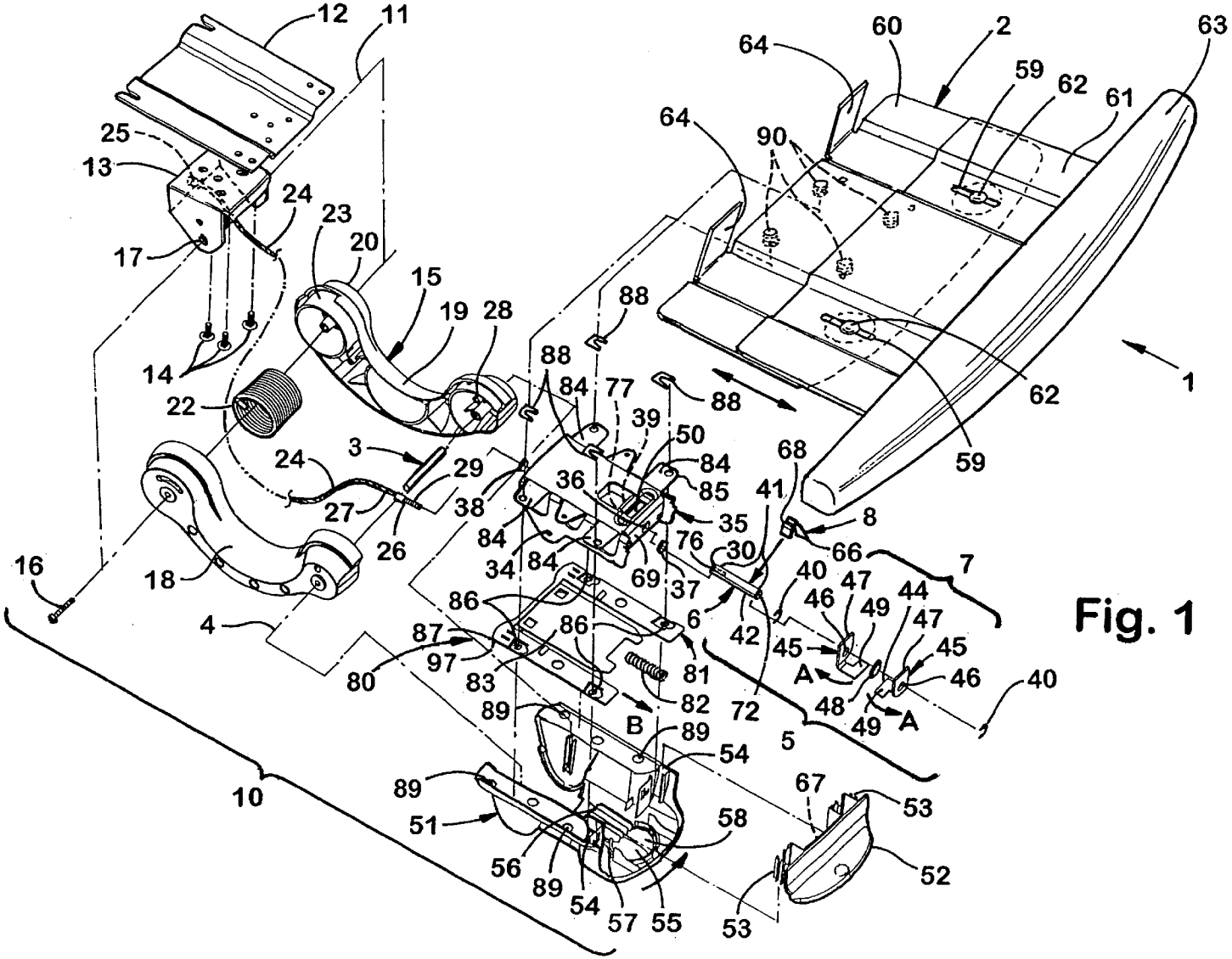
FIG. 1 is an exploded, perspective view of an adjustable support for keyboards and the like embodying the present invention, including a tilt stop and a quick-disconnect connector for the keyboard support member.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates an adjustable support for computer keyboards and the like 1 embodying the present invention. In the illustrated example, the adjustable support 1 includes a support member 2 shaped to retain an associated keyboard (not shown) thereon. The support member 2 is pivotally mounted, such as by a pin 3, to shift about a normally, generally horizontal pivot axis 4 to define a tilt angle for the support member 2 and the keyboard with respect to a user. The tilt angle is adjustable within a predetermined tilt range. A tilt adjustment controller 5 is operatively connected with the support member 2, and includes a tilt rod 6 and a releasable lock 7 which move relative to one another when the support member 2 is pivoted about the tilt axis 4 for adjustment of the tilt angle. The lock 7 engages the tilt rod 6 in a locked position to retain the support member 2 at a selected tilt angle. The lock 7 disengages the tilt rod 6 in an unlocked position to permit the support member 2 to pivot freely within the tilt range. A tilt stop 8 is positioned on the tilt rod 6, and restricts movement between the tilt rod 6 and the lock 7 when the lock 7 is in the unlocked position to thereby reduce the tilt range of the support member 2.

Figure 12:
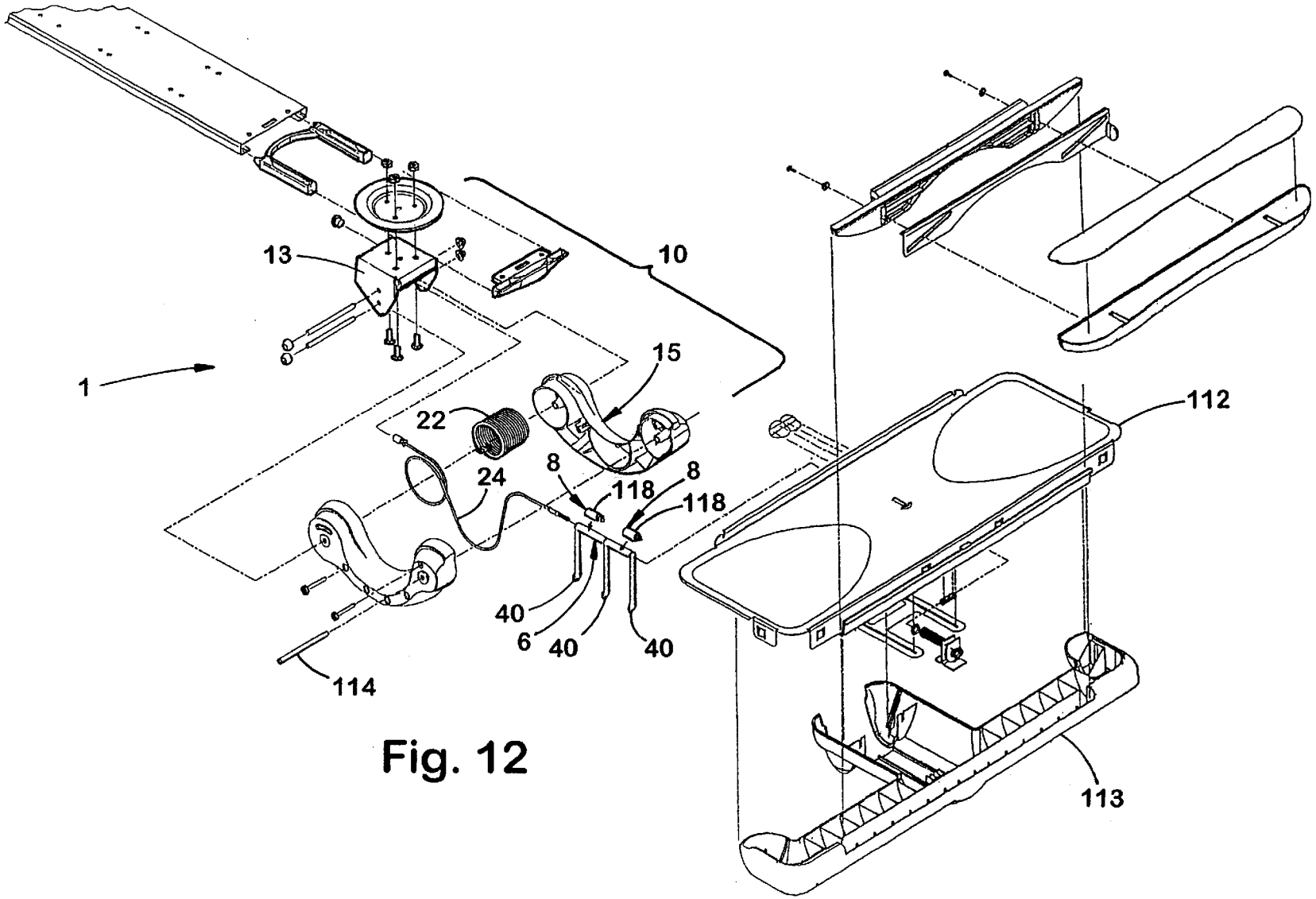
FIG. 12 is an exploded, perspective view of an adjustable support showing the second embodiment of the tilt stop.

The adjustable support 1 includes a support arm assembly 10 and a keyboard support member 2. A base 12 is configured to be secured to the lower surface of an associated worksurface (not shown). A mounting bracket 13 is fastened to the base 12 by fasteners such as screws 14. Alternatively, the bracket 13 may be attached to a sliding track mount as illustrated in the embodiment of FIG. 12 discussed below. An arm 15 comprises a first half 18 and a second half 19 (FIG. 1). The arm 15 is rotatably mounted to the mounting bracket 13 at openings 17 by a second, or base pin 16. A torsion spring 22 is connected to the mounting bracket 13 and the arm 15, and biases the support member 2 upwardly to counteract the downward moment due to the weight of the support 2 and associated keyboard. The spring 22 fits within a drum or hub 23 formed at a base end 20 of the second half 19 of the arm 15. A first end 25 of a flexible line such as cable 24 is connected to the mounting bracket 13, and a second end 26 of the cable 24 is connected to the tilt rod 6. The cable 24 includes several loops (not shown) around the hub or drum 23 such that when the cable 24 is tensed, the cable 24 frictionally engages the hub 23, and prevents rotation of the arm 15 about a base pivot axis 11 at base pin 16. When the cable 24 is slackened, the cable 24 does not frictionally engage the hub 23, such that the height of the support member 2 may be adjusted by pivoting the arm 15 about the base pivot axis 11.

An end portion 27 of cable 24 is slidably supported on a lower hub 28 of the second half 19 of the arm 15. The weight of the associated keyboard and support member 2 acts downwardly, thereby generating a moment about the horizontal tilt axis 4. However, because the end portion 27 of the cable 24 is spaced above the tilt axis 4 by the lower hub 28, tension in the cable 24 generates a couple which prevents rotation about the tilt axis 4.

Figure 1C:
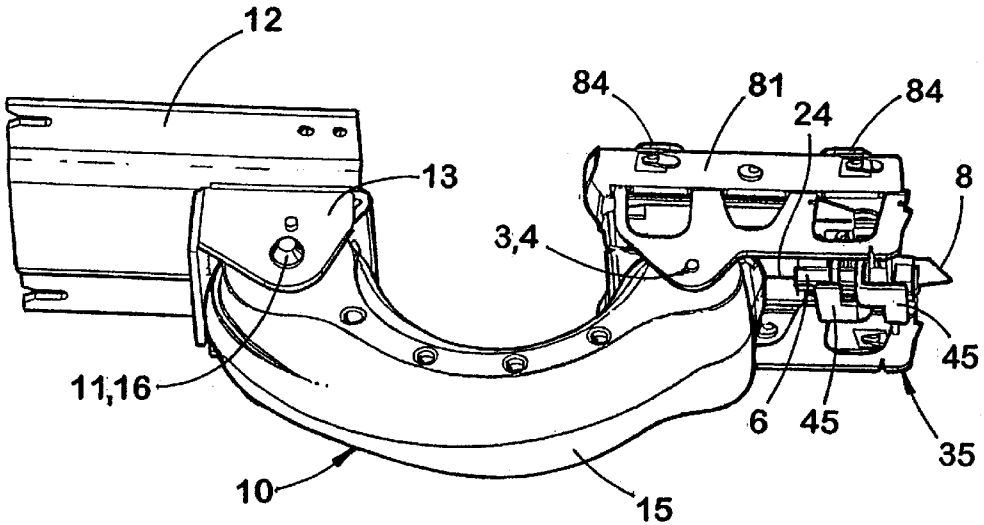
FIG. 1C is a perspective view of the support arm in an assembled condition.
Figure 1A:
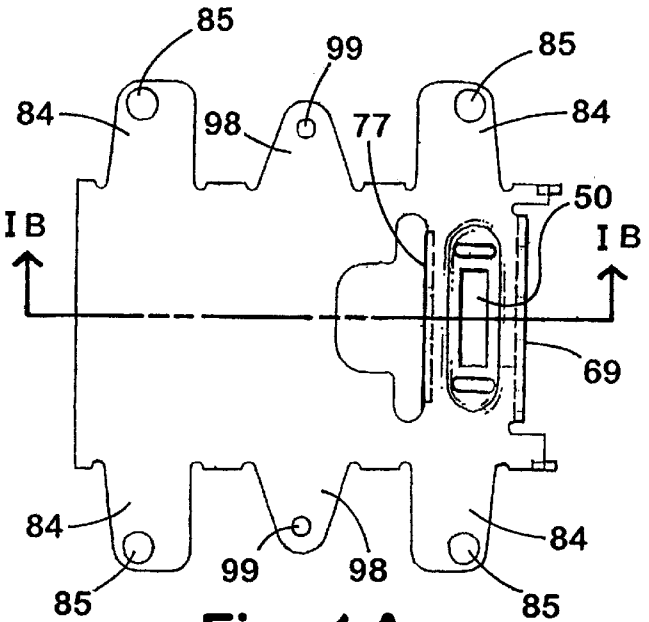
FIG. 1A is a top plan view of the universal bracket.
Figure 1B:
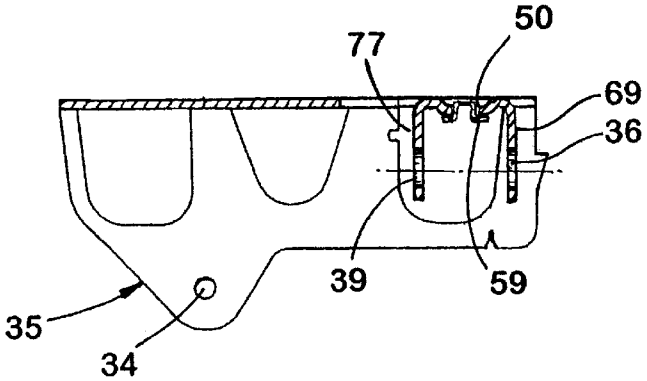
FIG. 1B is a cross-sectional view of the universal bracket taken along the line IV—IV of FIG. 1A.

A threaded portion 29 of the second end 26 of the cable 24 is connected to a threaded first end 30 of the tilt rod 6. The tilt rod 6 is slidably mounted in a bracket or housing 35. The bracket or housing 35 is formed from sheet metal, and includes lower openings 34 that pivotally connect the bracket or housing 35 to the arm 15 at the tilt axis 4. A first bushing 37 is mounted in an opening 36 of end wall 69 of bracket or housing 35, and a second bushing 38 is mounted in a second opening 39 (see also FIG. 1C) of an inner wall 77 that is spaced-apart, and parallel to end wall 69. When the tilt rod 6 is installed through the bushings 37 and 38, clips 40 are received on the grooved ends 41 of the tilt rod 6 such that the tilt rod 6 is slidably retained to the bracket or housing 35. Tilt rod 6 is received in openings 46 in a pair of L-shaped lock plates 45. Lock plates 45 are located between end wall 69 and inner wall 77 when assembled (FIGS. 1C, 1D) in a manner similar to that of the embodiment illustrated in FIG. 14. The upper end or edge 47 (FIG. 1) of each L-shaped lock plate 45 is received in a rectangular opening 50 in bracket or housing 35 (see also FIGS. 1A and 1B). A plastic fitting 59 having a generally downwardly opening U-shaped cross section within which the upper ends 47 of the lock plates 45 are pivotally received may be located in the rectangular opening 50. A small coil spring 48 is located on the tilt rod 6 between the lock plates 45 (FIG. 1). The spring 48 biases the lock plates 45 apart in the direction of the arrows "A". The lock plates 45 pivot about the upper edges 47 such that the spring 48 causes the lock plates 45 to lock the tilt rod 6 in position due to the binding action between the tilt rod 6 and the openings 46. In the locked position, the tilt rod 6 is prevented from moving relative to the lock 7 and bracket or housing 35, such that the tilt angle of the support member 2 is fixed.

A lower housing 51 and cover member 52 are each made from a polymer material. The cover 52 includes protrusions 53 that are slidably received within channels 54 of lower housing 51. The lower housing 51 includes a release lever 55 that is flexibly connected to the housing 51 at a base end 56. The release lever 55 includes ribs 57 formed therealong, that are in close proximity to the lower portions or legs 49 of the lock plates 45. To release the lock 7, a user pushes upwardly on the end portion 58 of the release lever 55 with one or more fingers, causing the release lever 55 to flex upwardly. The lower portion 49 of each lock plate 45 is angled downwardly slightly, such that the lower edge 44 first contacts the ribs 57. The lower housing 51 and ribs 57 are made from a polymer material having a relatively low coefficient of friction such that the contact of the ribs 57 with the edge 44 causes each lock plate 45 to slide along the ribs 57 in a direction opposite the arrows "A", thereby causing the openings 46 of lock plates 45 to align with the tilt rod 6, allowing the tilt rod 6 to slide freely such that the tilt angle can be adjusted.

Figure 3:
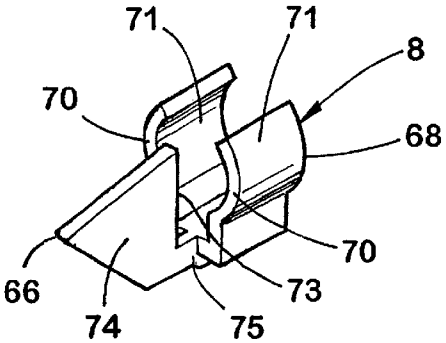
FIG. 3 is a perspective view of a first embodiment of the tilt stop.

The tilt stop 8 is preferably made of a flexible, polymeric material, and snaps over the end portion 42 of the tilt rod 6. When the tilt stop 8 is installed onto the end 42 of tilt rod 6, the end portion 66 of tilt stop 8 is directly proximate, or abutting the inner wall 67 of cover 52, and the other end 68 of tilt stop 8 contacts the end wall 69 of the bracket or housing 35. With further reference to FIG. 3, when the tilt stop 8 is placed on the end 42 of tilt rod 6, the edge 70 of the cylindrical tab portions 71 is directly adjacent to, or contacting the clip 40, such that the tilt rod 6 is prevented from sliding inwardly relative to the tilt stop 8. In addition, the end 72 of the tilt rod 6 contacts the inner edge 73 of the tab 74 of the tilt stop 8. Because the end 66 of stop 8 contacts the inner wall 67 of the cover 52, the tilt rod 6 cannot slide outwardly. In addition, as described above, the tilt rod 6 cannot slide inwardly because the clip 40 abuts the edge 70, while the end 68 abuts the end wall 69 of the bracket or housing 35. Accordingly, with the tilt stop 8 installed onto the tilt rod 6, the tilt rod 6 is prevented from moving, such that the tilt angle of the keyboard support member 2 cannot be adjusted. If desired for a particular application, the dimensions of tilt stop 8 may be chosen to limit the allowable range of tilt adjustment to a particular, smaller desired range without completely eliminating the range of tilt adjustment.

As best seen in FIG. 3, the tab 74 of tilt stop 8 has a relatively small base portion 75. If desired for a particular application, the tab 74 can be manually broken off at 75, such that the tilt rod 6 will not be prevented from traveling outwardly. Accordingly, with the tab 74 removed, the support member 2 may be tilted upwardly, with the maximum upward tilt being limited only by the engagement of the clip 40 at the inner end 76 of tilt rod 6 against the inner wall 77 of the bracket or housing 35 (FIG. 1).

With the tilt stop 8 removed from the tilt rod 6, the support member 2 may be adjusted across the entire, predetermined tilt range. The maximum downward, or positive, tilt occurs when the clip 40 located at the outer end 72 of tilt rod 6 contacts the end wall 69 of the bracket or housing 35. The maximum upward, or negative, tilt angle occurs when the clip 40 located at the inner end 76 of the tilt rod 6 contacts the inner wall 77 of the bracket or housing 35, as described above.

The support member 2 comprises a rear portion 60 and a forward portion 61 that are slidably interconnected by fasteners 62. A pair of slots 59 in the forward portion 61 slidably interconnect the forward portion 61 and the rear portion 60. A keyboard is placed between tabs 64 and hand support 63, and rear portion 60 and forward portion 61 are moved together to clamp the keyboard between the tabs 64 and hand rest 63. The fasteners 62 are then tightened to retain the keyboard. As described in more detail below, the support member 2 includes four adapters 90 that removably attach the support member 2 to the universal bracket or housing 35.

Figure 2:
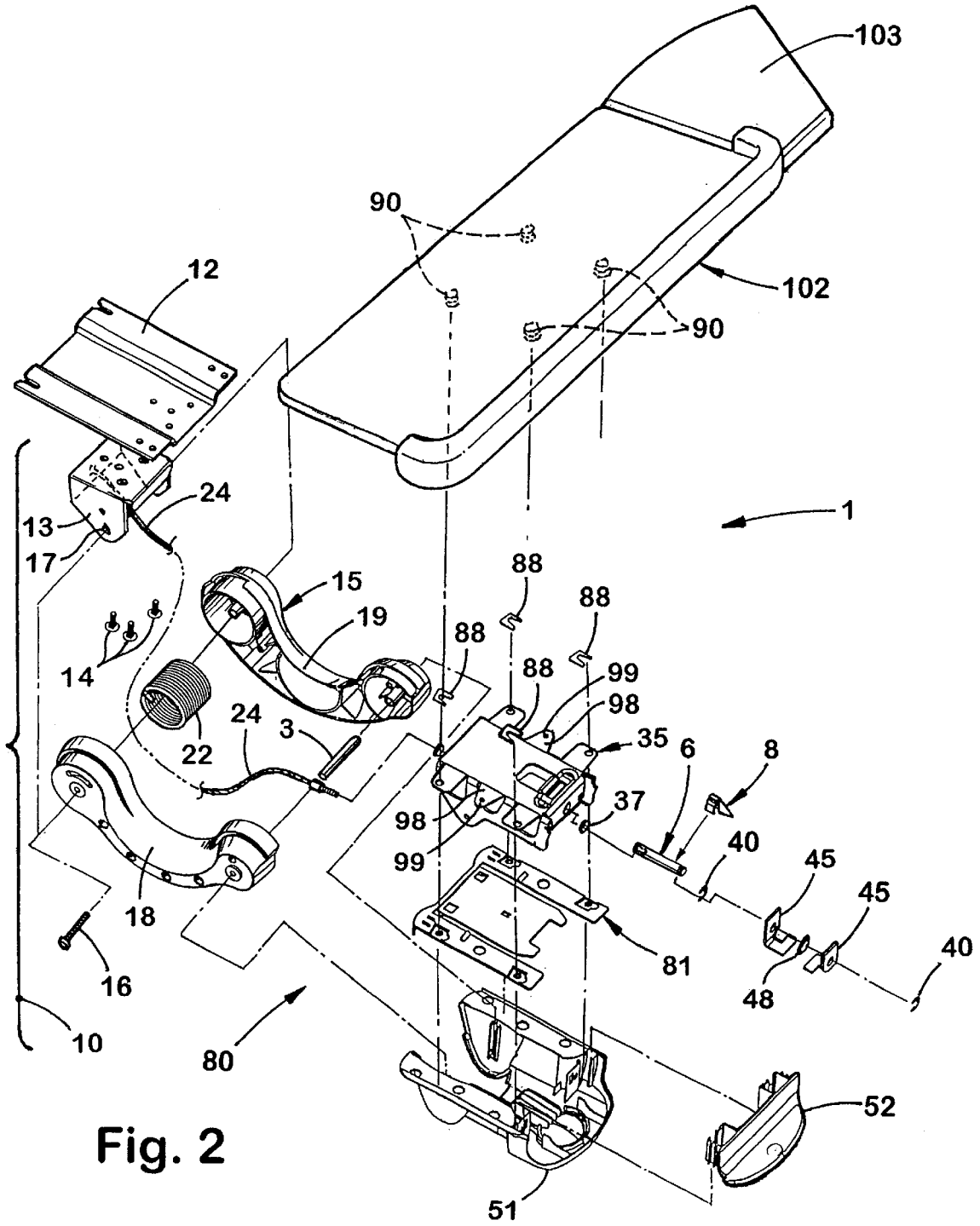
FIG. 2 is an exploded, perspective view of an adjustable support for computer keyboards and the like, wherein the keyboard support member is of a different type than that illustrated in FIG. 1, and includes a mouse support.

The keyboard support member 2 is removably connected to the universal bracket or housing 35 of the support arm assembly 10 by a quick-disconnect connector assembly 80. The quick-disconnect connector assembly 80 permits various types of keyboard support members to be interchangeably installed onto a support arm assembly 10 without the use of tools. As illustrated in FIG. 2, a second type of keyboard support 102 that includes a mouse support 103 may be interchangeably connected to the universal bracket or housing 35 of the support arm assembly 10. The keyboard support of FIG. 2 may be substantially the same as the support described in the above U.S. patent application Ser. No. 08/561,667, except that the support 102 illustrated in FIG. 2 has been modified to include adapters 90 to permit quick attachment and detachment to the support arm assembly 10. The quick-disconnect connector assembly 80 thereby allows a user to interchange various types of keyboard supports to reconfigure the support system to facilitate different users and tasks, without requiring that the entire adjustable support system be replaced.

Figure 1D:
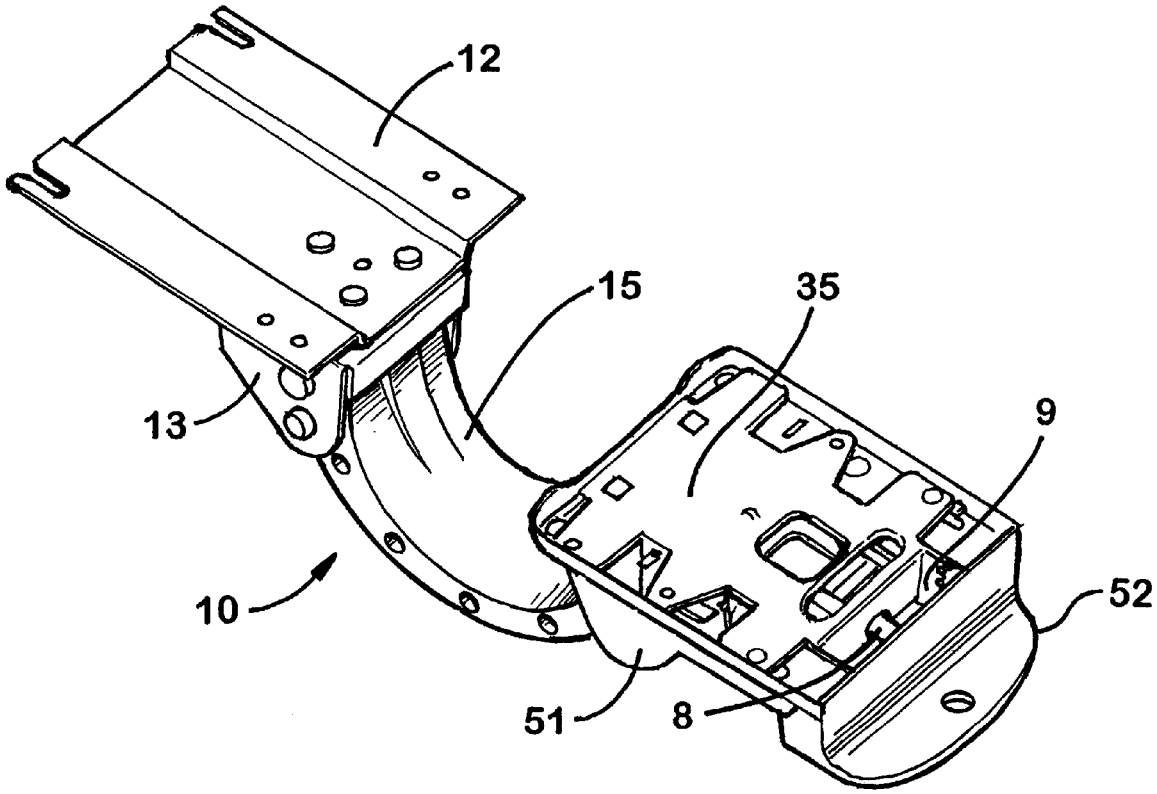
FIG. 1D is a perspective view of the support arm assembly, showing the opening in the housing to provide access to the tilt stop.

As best seen in FIG. 1D, when the support member 2 is removed from the arm assembly 10, and a clearance opening 9 is provided such that the tilt stop 8 may be removed from the tilt rod 6. However, when the support member 2 is in the installed position the support arm assembly 10, the tilt stop 8 is closed off, such that the tilt stop 8 cannot be removed.

With reference to FIG. 1, the quick-disconnect connector assembly 80 includes a polymeric slide plate 81 that is slidably mounted between the universal bracket or housing 35 and the lower housing 51. The slide plate 81 is biased in the direction of the arrow "B" by a tension spring 82 which is interconnected between opening or connector 83 on the slide plate 81 and another opening or connector (not shown) on the inner wall 77 of the universal bracket or housing 35. The universal bracket or housing 35 includes four tabs 84, each having an opening 85 therein. Four generally U-shaped metal inserts 88 are closely received in pockets 86 of the slide plate 81. Each pocket 86 has an opening 87 therethrough that aligns with an associated opening 85 in the universal bracket or housing 35.

Figure 9:
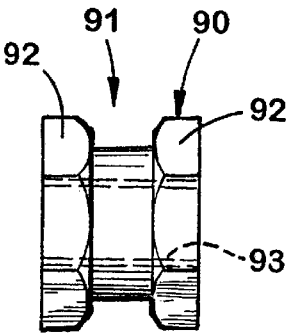
FIG. 9 is a side elevational view of the adaptor.
Figure 8:
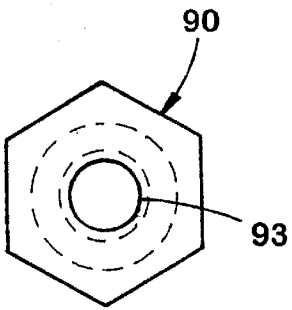
FIG. 8 is a front elevational view of the adaptor.
Figure 7:
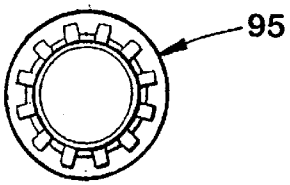
FIG. 7 is a side elevational view of a stud used to mount the adaptor for the quick-disconnect connector.
Figure 6:
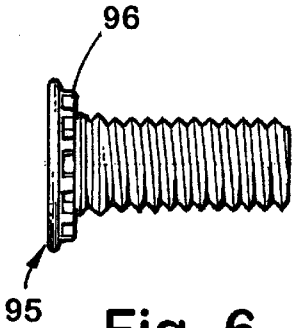
FIG. 6 is a front elevational view of a stud that mounts the adaptor for the quick-disconnect connector.
Figure 11:
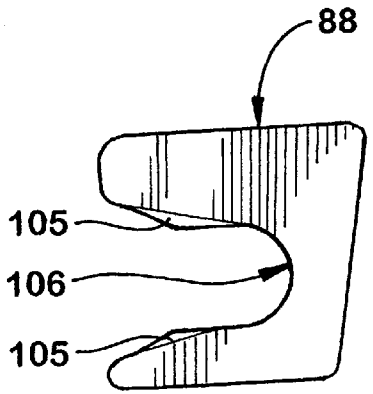
FIG. 11 is a front elevational view of the insert.
Figure 10:
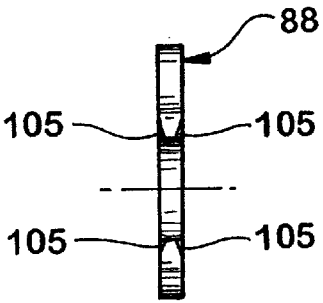
FIG. 10 is a side elevational view of the insert.

Each insert 88 fits into and around an annular groove 91 in an adapter 90 (FIGS. 8, 9) when the slide plate 81 is in the fully forward, or locked position, in the direction of the arrow "B" of FIG. 1. Each adapter 90 includes a pair of hexagonal outer portions 92 and a threaded opening 93, such that the adapter can be threaded onto a stud 95 (FIGS. 6, 7). Each stud 95 includes a shoulder 96 that retains the stud 95 to the keyboard support member 2 by press-fitting the stud 95 into a hole. With reference to FIGS. 10 and 11, each insert 88 is generally flat, forming a slot having a U-shape. Chamfered edge portions 105 facilitate engagement with the groove 91 of the adapter 90. The radiused edge 106 fits closely around the groove 91 of the adapter 90 when the slide plate 81 is in the locked, forward position.

When the keyboard support member 2 is in the installed position on the bracket or housing 35, each adapter 90 is received through an opening 85 in the bracket or housing 35, and through the opening 87 in the pocket 86 of the slide plate 81, and also through a clearance opening 89 in the lower housing 51. The inserts 88 are shown above the bracket or housing 35 in FIGS. 1 and 2. However, when in the installed position, the inserts 88 are received within the pockets 86 of the slide plate 81 below a tab 84 of the bracket or housing 35. The upper surface of slide plate 81 abuts the lower surfaces of tabs 84, such that each insert 88 is retained within a pocket 86. Tension spring 82 biases the slide plate 81 forwardly, such that each insert 88 closely engages the groove 91 of the adapter 90, thereby securely retaining the support member 2 to the bracket or housing 35.

To remove the support member 2, a user grasps the downwardly extending flange or handle portion 97 of the slide plate 81 and moves the slide plate 81 rearwardly. This causes the inserts 88 to slide rearwardly, out of engagement with the groove 91 of the adapter 90. With the slide plate 81 held in the rearward position, the support member 2 may be lifted upwardly to remove the adapters 90 from the universal bracket. To install the support member 2, the slide plate 81 is slid to the rearward position, and the adapters 90 are aligned with the openings 85, 86 and 89, and inserted therethrough. Upon release of the slide plate 81, the tension spring 82 will return the slide plate 81 to the forward position, thereby securely connecting the support member 2 to the bracket or housing 35 of the support arm assembly 10.

The bracket or housing 35 includes a pair of center tabs 98 with openings 99 therein. The tabs 98 and openings 99 may be used to attach a keyboard support using conventional fasteners, such as screws (not shown), without use of adapters 90, if desired for a given application.

Figure 13:
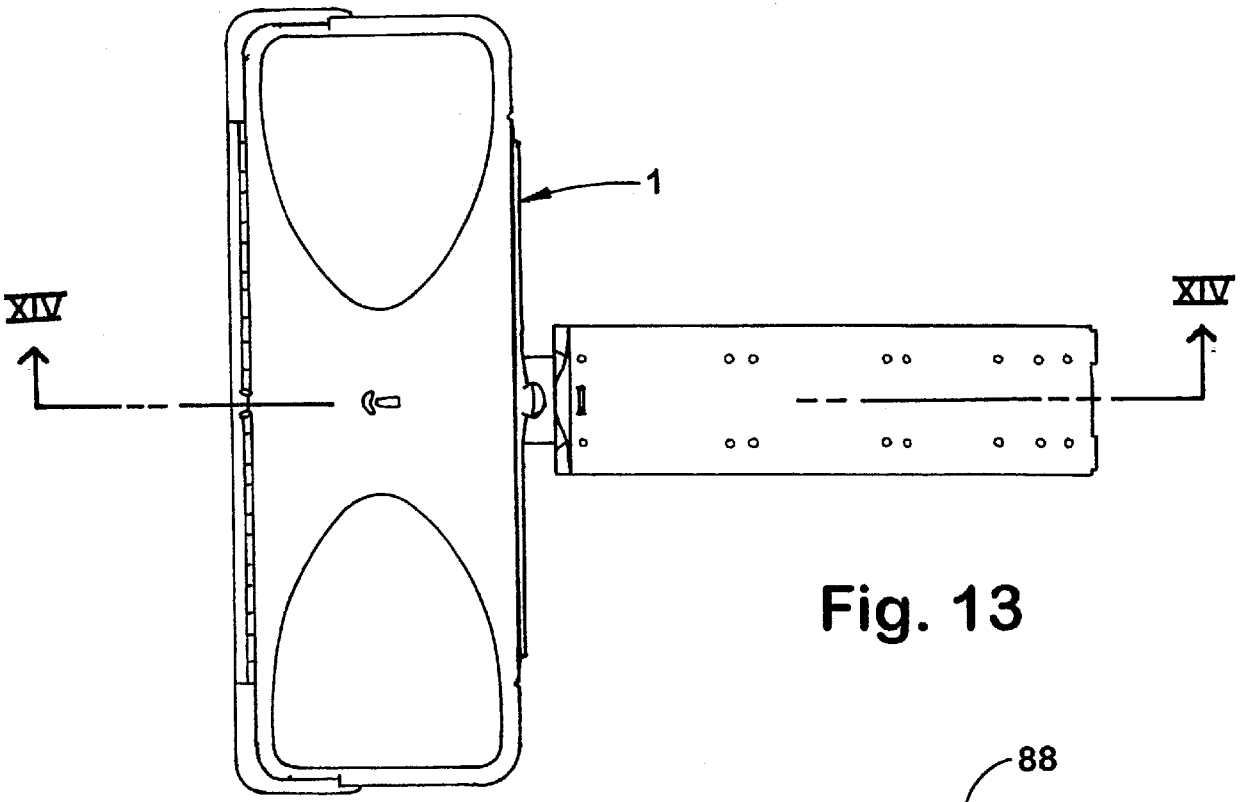
FIG. 13 is a top plan view of the adjustable support of FIG. 12.
Figure 14:
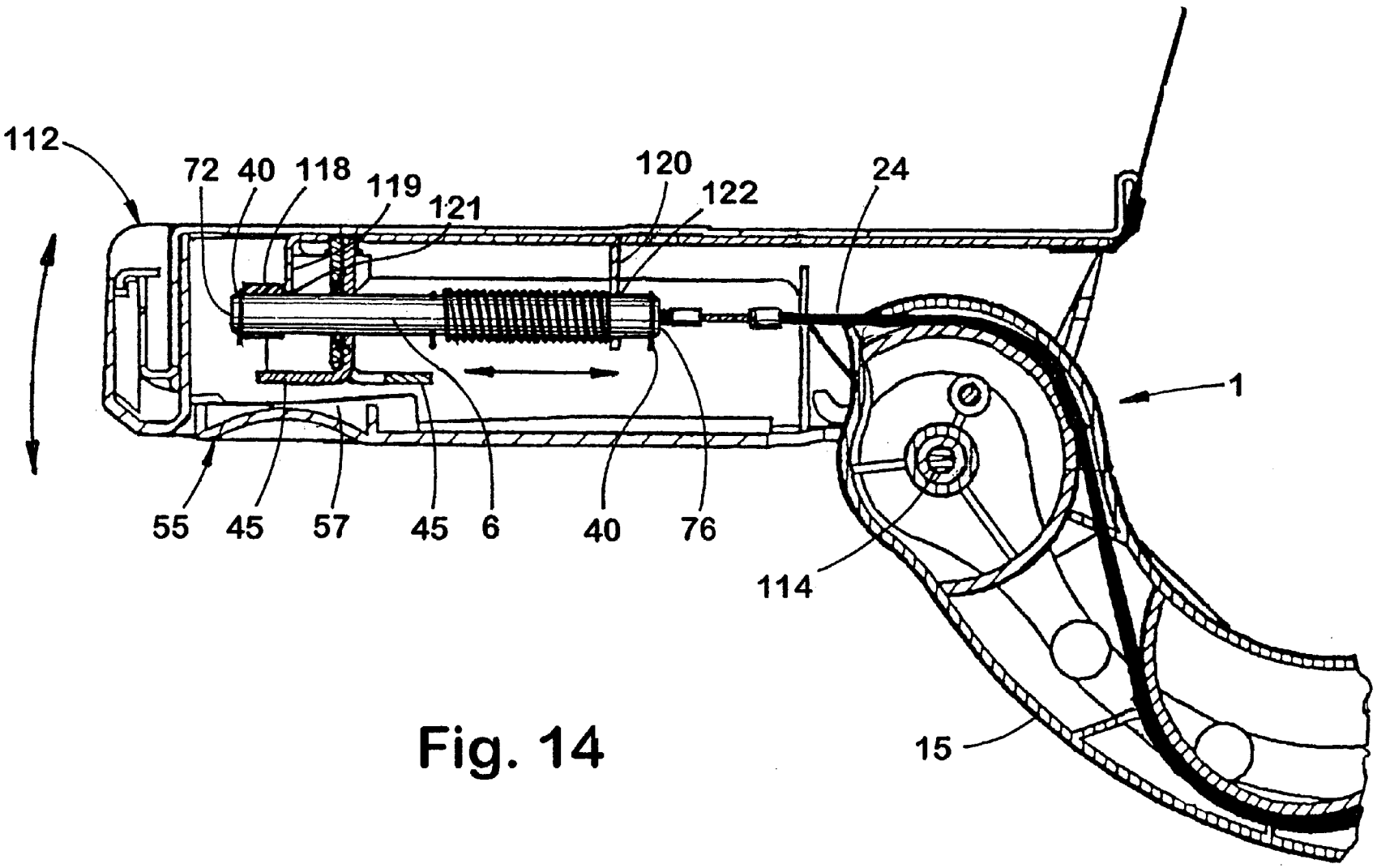
FIG. 14 is a fragmentary, cross-sectional view of the adjustable support taken along the line XIV—XIV of FIG. 13.

The adjustable support 1 illustrated in FIGS. 12–14 is substantially the same as the articulated keyboard shelf described in previously-referenced U.S. Pat. No. 5,836,560, entitled ARTICULATED KEYBOARD SHELF, filed on Nov. 22, 1995. This embodiment of the adjustable support has substantially the same support arm assembly 10 as the embodiments illustrated in FIGS. 1 and 2, except that the keyboard support illustrated in FIG. 12 does not include a quick-disconnect connector assembly 80, and the support member 112 is attached to the support arm assembly 10 in a relatively permanent manner by a lower support housing 113 and a pivot pin 114.

Figure 5:
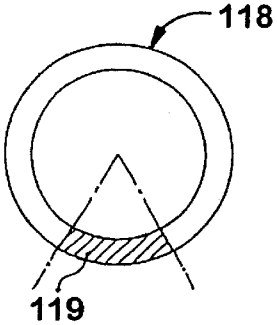
FIG. 5 is a side elevational view of the second embodiment of the tilt stop.
Figure 4:
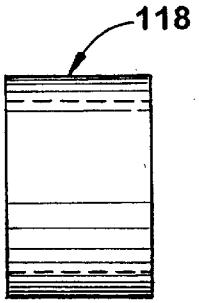
FIG. 4 is a front elevational view of a second embodiment of the tilt stop.

The tilt stop 8 illustrated in FIG. 12 comprises a tubular polymer member 118, that may have a portion 119 (FIG. 5) removed so that the tilt stop 118 may be snapped over the tilt rod 6. With reference to FIG. 14, the tilt rod 6 of this embodiment is slidably mounted in openings 121 and 122 of walls 119 and 120, respectively. Flexing of the release lever 55 upwardly against the lock plates 45 will cause the lock plates to move together into the position illustrated in FIG. 14, such that the tilt rod 6 can slide inwardly or outwardly to adjust the tilt angle of the support 112 about pin 114. With the tilt stop 118 installed adjacent the outer end 72 of the tilt rod 6, the support member 112 cannot be moved downwardly to a positive tilt angle because the tilt stop 118 prevents the clip 40 at the outer end 72 from contacting the first wall 119. However, if the tilt stop 118 is removed, the support 112 may be moved downwardly to a fully positive tilt angle. In addition, a second tilt stop 118 may be installed onto the tilt rod 6 adjacent the inner end 76 thereof, thereby preventing upward movement of support 112 to a negative tilt angle. If the inner end 76 of tilt rod 6 does not have a tilt stop 118 installed thereon, support 112 may be moved upwardly to a negative tilt angle until clip 40 at the inner end 76 of the tilt rod 6 contacts the second wall 120. Accordingly, if a tilt stop 118 is snapped onto each end 72, 76 of tilt rod 6, the entire range of tilt adjustability can be eliminated. In addition, by selecting the length of the tilt stop 118, and/or installing a tilt stop 118 at only one end of the tilt rod 6, any desired limitation of the range of allowable tilt can be achieved.

Figure 16:
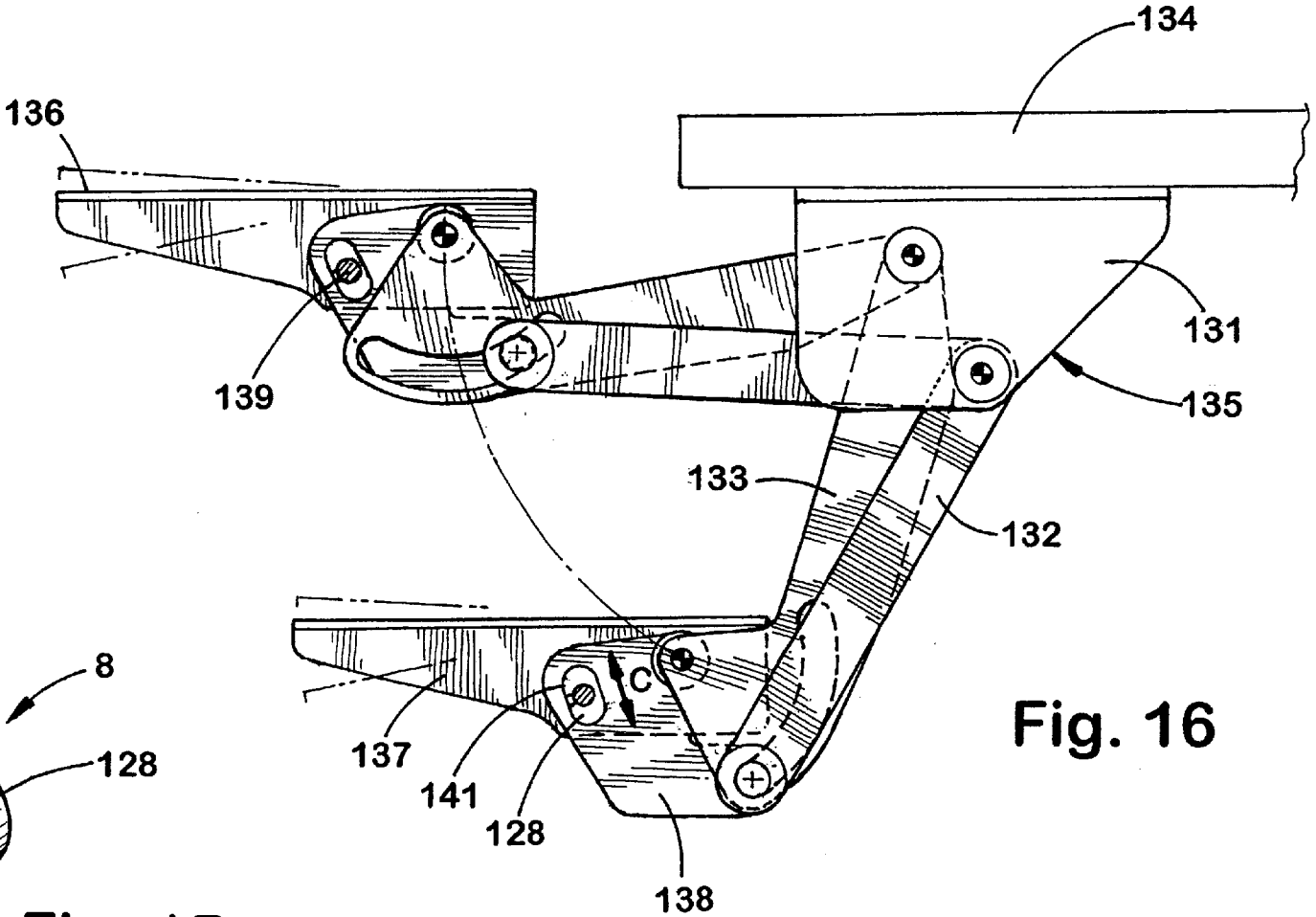
FIG. 16 is a side elevational view of an adjustable support for computer keyboards and the like, including the third embodiment of the tilt stop.
Figure 15:
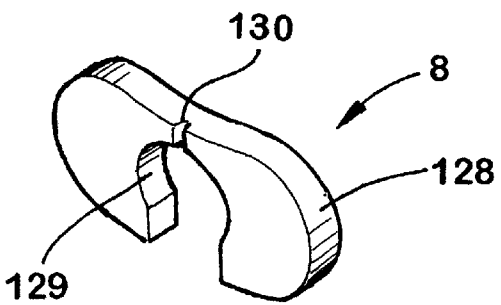
FIG. 15 is a perspective view of a third embodiment of the tilt stop.
Figure 17:
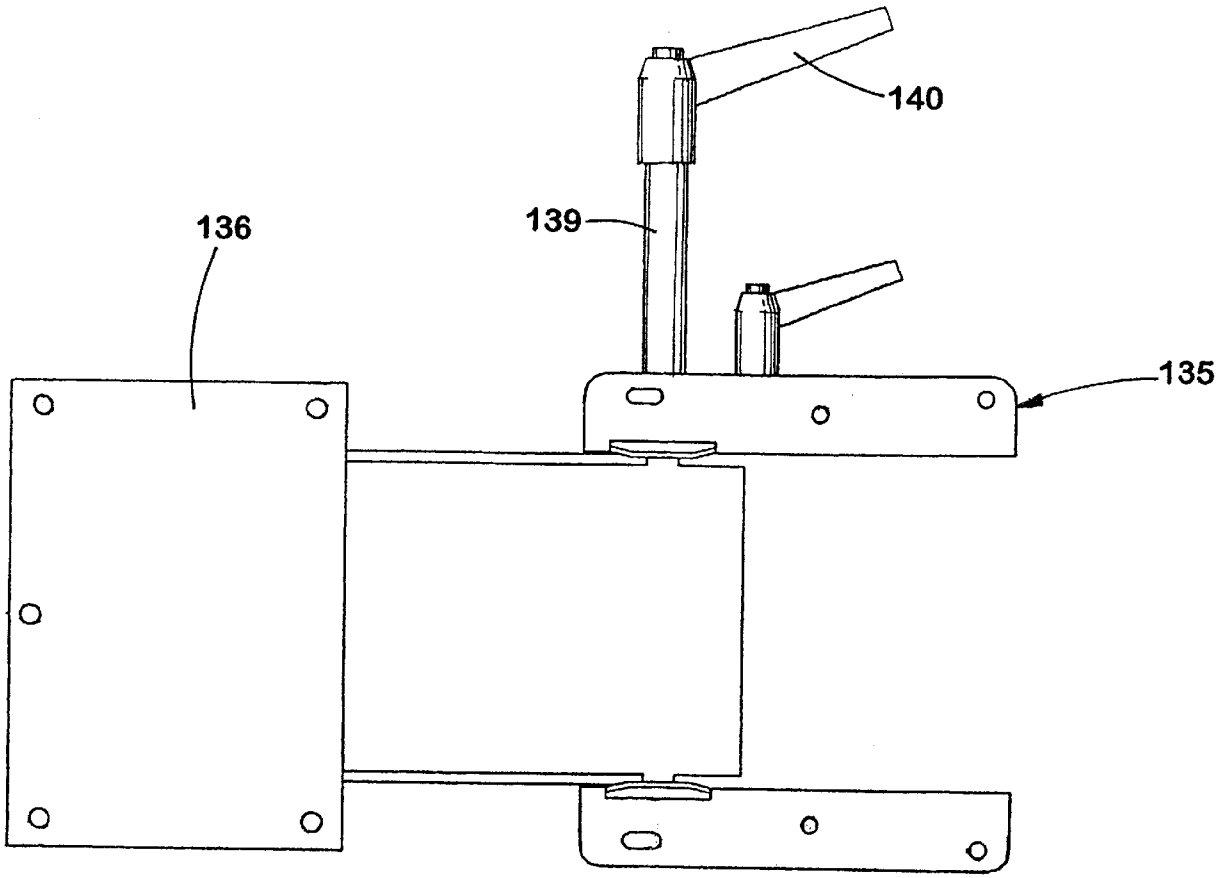
FIG. 17 is a top plan view of an adjustable support for computer keyboards and the like, including the third embodiment of the tilt stop.

A third embodiment of the tilt stop 8 is illustrated in FIG. 15. The tilt stop 8 comprises a flat polymer member 128 having a cut-out portion 129 and a V-notch 130. With reference to FIGS. 16 and 17, another type of adjustable support 135 may be mounted to the lower surface of an associated worksurface 134. The adjustable support 135 illustrated in FIGS. 16 and 17 is of a different type than those illustrated in FIGS. 1, 2 and 12. A support surface 136 is configured to support a keyboard support platform. Arms 132 and 133 are pivotally connected to a base 131. The support 136 includes at least one sidewall 137 extending downwardly directly adjacent a sidewall 138. The tilt angle of support surface 136 does not change during height adjustment of the support surface 136. A rod 139 has a threaded end (not shown) and a handle 140 at the other end. Rod 139 is closely received in a circular opening (not shown) in sidewall 137, and also through an arcuate slot 141 in the sidewall 138. If the tilt stop 128 is not installed, the rod 139 may travel along the arcuate slot 141 upon adjustment of the tilt angle of the support surface 136. The handle 140 is then turned to lock the support surface 136 at the desired angle, such that the rod 139 cannot move along the arcuate slot 141. To lock out, and prevent tilt adjustment of the support surface 136, the tilt stop 128 is snapped over the rod 139, and slid inwardly along the rod until the tilt stop 128 is received in the arcuate slot 141. The outer contour of the tilt stop 128 closely matches the arcuate slot 141, and the cut-out portion 129 closely matches the outer diameter of rod 139, such that the rod 139 is substantially held in position, preventing tilt adjustment of the support surface 136. If desired for a particular application, cut-out 129 may be offset, such that the support surface 136 is locked at a selected tilt angle. Alternatively, the dimensions of the tilt stop 128 could be adjusted, such that the tilt stop 128 slides within slot 141 with only a selected portion of the tilt adjustment range eliminated. In addition, tilt stop 128 may be manually broken apart at V-notch 130 to produce two halves. One half may then be installed to selectively permit only positive or negative tilt angles.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A keyboard support assembly for supporting computer keyboards and the like, comprising:

an articulating support arm having an end portion adapted to be secured to an associated base, and an opposite end portion;

a keyboard support member adapted to support a keyboard thereon; and a threadless quick connector releasably connecting said keyboard support member to said articulating support arm adjacent said opposite end portion thereof.

2. The keyboard support assembly set forth in claim 1, wherein:

said threadless quick connector includes a first lock member positioned on a selected one of said articulating support arm and said keyboard support member, and a second lock member movably mounted on the other of said articulating support arm and said keyboard support member, said second lock member shiftable between a disengaged position and an engaged position wherein said second lock member engages said first lock member to secure said keyboard support member to said articulating support arm adjacent said opposite end.

3. The keyboard support assembly set forth in claim 2, wherein:

said second lock member is biased into said engaged position.

4. The keyboard support assembly set forth in claim 3, wherein:

said first lock member comprises a protrusion having an annular groove; and said second lock member comprises a plate having an elongated opening therethrough forming spaced-apart side edges received within said annular groove when said second lock member is in said engaged position.

5. The keyboard support assembly set forth in claim 3, wherein:

said second lock member includes a handle to permit manual shifting between said engaged and disengaged positions.

6. A keyboard support assembly for supporting keyboards and the like, comprising:

an articulating support arm having an end portion adapted to be secured to an associated base, and an opposite end;

a keyboard support member adapted to support a keyboard thereon;

a first lock member positioned on a selected one of said articulating support arm and said keyboard support member; and a second lock member movably mounted on the other of said articulating support arm and said keyboard support member, said second lock member shiftable between a disengaged position and an engaged position wherein said second lock member engages said first lock member to secure said keyboard support member to said articulating support arm adjacent said opposite end.

7. The keyboard support assembly set forth in claim 6, wherein:

said second lock member is biased into said engaged position.

8. The keyboard support assembly set forth in claim 7, wherein:

said first lock member comprises a stud having an annular groove; and said second lock member comprises a plate having an elongated opening therethrough, forming spaced-apart side edges received within said groove when said second lock member is in said engaged position.

9. The keyboard support assembly set forth in claim 6, wherein:

said second lock member includes a handle to permit manual shifting between said engaged and disengaged positions.

10. A keyboard support assembly for supporting keyboards, comprising:

an articulating support arm;

a keyboard support platform adapted to support a keyboard thereon;

a projection on a selected one of said articulating support arm and said keyboard support platform, said projection defining a first engagement surface; and a movable lock member movably mounted on the other of said articulating support arm and said keyboard support platform, said lock member shiftable between a released position and a locked position wherein said lock member engages said first engagement surface and secures said keyboard support platform to said articulating support arm.

11. The keyboard support assembly set forth in claim 10, wherein:

said projection comprises a protrusion having at least one groove forming said first engagement surface; and said movable lock member comprising a plate having an elongated opening therethrough defining spaced-apart edges that are received in said groove when said plate is in said locked position.

12. The keyboard support assembly set forth in claim 11, including:

a spring biasing said plate into said locked position.

13. The keyboard support assembly set forth in claim 12, wherein:

said plate is slidably mounted for longitudinal shifting between said locked and unlocked positions.

* * * * *